US006596678B2

(12) United States Patent
Panandiker et al.

(10) Patent No.: US 6,596,678 B2
(45) Date of Patent: Jul. 22, 2003

(54) LAUNDRY DETERGENT COMPOSITIONS CONTAINING A POLYMER FOR FABRIC APPEARANCE IMPROVEMENT

(75) Inventors: Rajan Keshav Panandiker, West Chester, OH (US); William Conrad Wertz, West Harrison, IN (US); Sherri Lynn Randall, Hamilton, OH (US)

(73) Assignee: The Procter & Gamble Co., Cincinnati, OH (US)

( * ) Notice: Subject to any disclaimer, the term of this patent is extended or adjusted under 35 U.S.C. 154(b) by 0 days.

(21) Appl. No.: 09/843,571

(22) Filed: Apr. 26, 2001

(65) Prior Publication Data

US 2001/0056058 A1 Dec. 27, 2001

Related U.S. Application Data

(60) Provisional application No. 60/202,623, filed on May 9, 2000.

(51) Int. Cl.[7] ..... C11D 1/83; C11D 1/62; C11D 3/26; C11D 3/395; C11D 7/42

(52) U.S. Cl. ..... 510/303; 510/305; 510/308; 510/309; 510/311; 510/318; 510/320; 510/321; 510/340; 510/361; 510/372; 510/375; 510/376; 510/475; 510/477; 510/499; 510/504

(58) Field of Search ..... 510/303, 305, 510/308, 309, 311, 318, 320, 321, 340, 361, 372, 375, 376, 475, 477, 499, 504

(56) References Cited

U.S. PATENT DOCUMENTS

| | | | | | |
|---|---|---|---|---|---|
| 6,025,322 | A | * | 2/2000 | Boeckh et al. | 510/516 |
| 6,191,093 | B1 | * | 2/2001 | Watson et al. | 510/400 |
| 6,194,370 | B1 | * | 2/2001 | Williams, Jr. et al. | 510/320 |
| 6,221,825 | B1 | * | 4/2001 | Williams, Jr. et al. | 510/320 |
| 6,262,011 | B1 | * | 7/2001 | Boeckh et al. | 510/475 |

FOREIGN PATENT DOCUMENTS

| | | | |
|---|---|---|---|
| GB | 2 039 938 A | | 9/1979 |
| WO | WO 98/17762 | * | 4/1998 |
| WO | WO 98/29527 | * | 7/1998 |
| WO | WO 00/22079 | | 4/2000 |
| WO | WO 01/25386 A1 | | 4/2001 |

* cited by examiner

*Primary Examiner*—Gregory Delcotto
(74) *Attorney, Agent, or Firm*—Marianne Dressman; Julia A. Glazer; Kim W. Zerby

(57) ABSTRACT

Detergent compositions and fabric conditioning compositions which include from about 0.01% to about 5.0%, by weight, of polyelectolyte complexes having a compatible charge-balancing polymeric anion with at least 3 anionic groups and a total net charge of at least 4 negative charges.

17 Claims, No Drawings

LAUNDRY DETERGENT COMPOSITIONS CONTAINING A POLYMER FOR FABRIC APPEARANCE IMPROVEMENT

CROSS REFERENCE TO RELATED APPLICATIONS

This application claims priority under 35 U.S.C. §119(e) to U.S. Provisional Application Serial No. 60/202,623, filed May 9, 2000.

TECHNICAL FIELD

The present invention relates to laundry detergent compositions containing a polyelectrolyte complex of cationic and anionic polymers comprising cationic condensates of (i) at least one amine and (ii) a crosslinking agent from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides and/or mixtures of said compounds, and a polymeric anion source with at least 3 anionic groups and a total net charge of at least 4 negative charges; wherein the charge ratio between anionic and cationic polymers is from 0.01 to 20.

This combination imparts appearance and integrity benefits to fabrics and textiles laundered in washing solutions formed from such compositions.

BACKGROUND OF THE INVENTION

Alternating cycles of using and laundering fabrics and textiles, such as articles of worn clothing and apparel, has been shown to adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which can be added to laundry detergent products that would associate themselves with the fibers of the fabrics and textiles laundered using such detergent products and thereby reduce or minimize the tendency of the laundered fabric/textiles to deteriorate in appearance. The detergent product additive material must benefit fabric appearance and integrity without unduly interfering with the ability of the laundry detergent to perform its fabric cleaning function. The present invention is directed to the use of certain polyclectolyte complexes in laundry detergent compositions that provide the above detailed fabric integrity benefits.

SUMMARY OF THE INVENTION

The aforementioned needs are met by the present invention wherein a detergent composition or additive comprising a detersive surfactant system, a fabric appearance component and the balance detergent adjunct ingredients is provided. The fabric appearance component comprises a polyelectrolyte complex of cationic and anionic polymers comprising:

(a) cationic condensates of (i) at least one amine selected from the group consisting of linear alkylamines, branched alkylamines, cycloalkylamines, alkoxyamines, amino alcohols, cyclic amines containing at least one nitrogen atom in a ring structure, alkylenediamines, polyetherdiamines, polyalkylenepolyamines, mixtures of one of the said amines with at least one amino acid or a salt thereof, reaction products of the said amines with at least one anionic group containing alkylating agent wherein per mole of NH group of the amines of from 0.04 to 0.6 moles of the anionic group containing alkylating agent is reacted, and mixtures thereof, and (ii) a crosslinking agent selected from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides, mixtures thereof, and quaternized cationic condensates of (i) and (ii) and;

(b) a polymeric anion source with at least 3 anionic groups and a total net charge of at least 4 negative charges; wherein the charge ratio between anionic and cationic polymers is from 0.01 to 20.

The polyelectrolyte complex defined above can be used, independently or optionally, along with a hydrophobically modified cellulosic based polymers or oligomers, as a washing solution additive. Alternatively, they can be admixed to granular or liquid detergents or added to a fabric softening composition.

The laundry detergent compositions herein comprise from about 1% to 80% by weight of a detersive surfactant, from about 0.01% to 80% by weight of an organic or inorganic detergency builder and from about 0.01% to 5%, by weight, of a polyelectrolyte complex and, other adjunct detergent ingredients. The detersive surfactant and detergency builder materials can be any of those useful in conventional laundry detergent products.

Aqueous solutions of the fabric-treating polyelectrolyte complex of the subject invention comprise from about 0.01% to 80% by weight of the solution. The balance of the aqueous solution comprises water and other ingredients such as stabilizers and pH adjusters.

In its method aspect, the present invention relates to the laundering or treating of fabrics and textiles in aqueous washing or treating solutions formed from effective amounts of the detergent or laundry additive compositions described herein, or formed from the individual components of such compositions. Laundering of fabrics and textiles in such washing solutions, followed by rinsing and drying, imparts fabric appearance benefits to the fabric and textile articles so treated. Such benefits can include improved overall appearance, pill/fuzz reduction, anti-fading, improved abrasion resistance, and/or enhanced softness.

DETAILED DESCRIPTION OF THE INVENTION

Is has been discovered that the aforementioned needs are met by providing a detergent composition comprising a detersive surfactant system, adjunct detergent ingredients and polyelectrolyte complexes of cationic and anionic polymers comprising:

(a) cationic condensates of (i) at least one amine selected from the group consisting of linear alkylamines, branched alkylamines, cycloalkylamines, alkoxyamines, amino alcohols, cyclic amines containing at least one nitrogen atom in a ring structure, alkylenediamines, polyetherdiamines, polyalkylenepolyamines, mixtures of one of the said amines with at least one amino acid or a salt thereof, reaction products of the said amines with at least one anionic group containing alkylating agent wherein per mole of NH group of the amines of from 0.04 to 0.6 moles of the anionic group containing alkylating agent is reacted, and mixtures thereof, and (ii) a crosslinking agent from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides and/or mixtures of said compounds, and (b) anionic compounds containing at least three anionic groups; wherein the charge ratio between anionic and cationic polymers is from 0.01 to 20.

The polyelectrolyte complex described herein will generally comprise from about 0.01% to about 5% by the weight of the composition. More preferably, the polyelectrolyte complex will comprise from about 0.1% to about 4% by weight of the compositions, most preferably from about 0.2% to about 3%. However, as discussed above, when used as a washing solution additive, i.e. when the polyelectrolyte complex is not incorporated into a detergent composition, the concentration of the polyelectrolyte complex can comprise from about 0.1% to about 80% by weight of the additive material.

Specific examples of the said consendates are methylamine, ethylamine, n-propylamine, isopropylamine, n-butylamine, isobutylamine, pentylamine, hexylamine, heptylamine, octylamine, 2-ethylhexylamine, isooctylamine, nonylamine, isononylamine, decylamine, undecylamine, dodecyclamine, tridecylamine, stearylamine, palmitylamine, dimethylamine, diethylamine, dipropylamine, dibutylamine, dipentylamine, dihexylamine, bis-(2-ethylhexyl)amine, ditridecylamine, N-methylbutylamine, N-ethylbutylamine, piperidine, morpholine, pyrrolidine, 2-methoxyethylamine, 2-ethoxyethylamine, 3-ethoxypropylamine, 3-ethoxypropylamine, 3-[(2-ethylhexyl)oxy]-1-propaneamine, 3-[(2-methoxyethoxy]-1-propaneamione, 2-methoxy-N-(2-methoxyethyl)ethanamine, 2-aminoethanol, 3-amino-1-propanol, 1-amino-2-propanol, 2-(2-ami-noethoxy)ethanol, 2-[(2-minoethyl)amino] ethanol, 2-(methyl-amino)ethanol, 2-(ethylamino)ethanol, 2-(butylamino)ethanol, diethanolamine, 3-[(2-hydroxyethyl)amino]1-propanol, diisopropanolamine, bis-(2-bydroxyethyl)aminoethylamine, bis-(2-hydroxypropyl) aminoethylamine, bis-(2-hydroxyethyl)aminopropyl-amine, bis-(2-hydroxypropyl)aminopropylamine, cyclopentylamine, cyclohexylamine, N-methylcyclohexylamine, N-ethylcyclohexylamine, dicyclohexylamine, ethylenediamine, propylenediamine, butylenediamine, neopentyldiamine, hexamethylenediamine, octamethylenediamine, isophoronediamine, 4,4'-methylenebiscyclohexylamine, 4,4'-methylenebis(2-methylcyclohexylamine), 4,7-dioxadecyl-1,10-diamine, 4,9-dioxadodecyl-1,12-diamine, 4,7,10-trioxatridecyl-1,13-diamine, 2-(ethylamino) ethylamine, 3-(methylamino)propylamine, 3-(cyclohexylamino)propylamine, 3-aminopropylamine, 2-(diethylamino)ethylamine, 3-(dimethylamino) propylamine, 3-(diethylamino)propylamine, dipropylenetriamine, tripropylenetetramine, N,N-bis-(aminopropyl)methylamine, N,N-bis-(aminopropyl) ethylamine, N,N-bis-(aminopropyl)hexylamine, N,N-bis-(aminopropyl)octylamine, 1,1-dimethyldipropylenetriamine, N,N-bis-(3-dimethylaminopropyl)amine, N,N"-1,2-ethanediylbis-(1,3-propanediamine), diethylenetriamine, bis-(aminoethyl) ethylenediamine, bis-(aminopropyl)ethylenediamine, bis-(hexamethylene)triamine, N-(aminoethyl) hexamethylenediamine, N-(aminopropyl) hexamethylenediamine, N-(aminopropyl)ethylenediamine, N-(aminoethyl)butylenediamine, N-(aminopropyl) butylenediamine, bis-(aminoethyl)hexamethylenediamine, bis-(aminopropyl)hexamethylenediamine, bis-(aminoethyl) butylenediamine, bis-(aminopropyl)butylenediamine, 4-aminomethyloctane-1,8-diamine, and N,N-diethyl-1,4-pentanediamine.

Cyclic amines containing at least one nitrogen atom in a ring structure are for example monoaminoalkylpiperazines, bis(aminoalkyl)piperazines, monoaminoalkylimidazoles, aminoalkylmorpholines, aminoalkylpiperidines and aminoalkylpyrrolidines. The monoaminoalkylpiperazines are for example 1-(2-aminoethyl)piperazine and 1-(3-aminopropyl)piperazine. Preferred monoaminoalkylimidazoles have 2 to 8 carbons atoms in the alkyl group. Examples of suitable compounds are 1-(2-aminoethyl)imidazole and 1-(3-aminopropyl)imidazole that. Suitable bis(aminoalkyl) piperazines are for example 1,4-bis(-2-aminoethyl) piperazine and 1,4-bis(3-aminopropyl)-piperazine. Preferred aminoalkylmorpholines are aminoethylmorpholine and 4-(3-aminopropyl)-morpholine. Other preferred compounds of this group are aminoethylpiperidine, aminopropylpiperidine and aminopropylpyrrolidine.

Cyclic amines with at least two reactive nitrogen atoms in the ring are for example imidazole, C-alkyl substituted imidazoles having 1 to 25 carbon atoms in the alkyl group such as 2-methylimidazole, 2-ethylimidazole, 2-propylimidazole, 2-isopropylimidazole and 2-isobutylimidazole, imidazoline, C-alkyl substituted imidazolines having 1 to 25 carbon atoms in the alkyl group and arylimidazolines such as 2-phenylimidazoline and 2-tolylimidazoline, piperazine, N-alkylpiperazines having 1 to 25 carbon atoms in the alkyl group such as 1-ethylpiperazine, 1-(2-hydroxy-1-ethyl)piperazine, 1-(2-hydroxy-1-propyl)piperazine, 1-(2-hydroxy-1-butyl) piperazine, 1-(2-hydroxy-1-pentyl)piperazine, 1-(2,3-dihydroxy-1-propyl)piperazine, 1-(2-hydroxy-3-phenoxyethyl)piperazine, 1-(2-hydroxy-2-phenyl-1-ethyl) piperazine, N,N'-dialkylpiperazines having 1 to 25 carbon atoms in the alkyl group for example 1,4-dimethylpiperazine, 1,4-diethylpiperazine, 1,4-dipropylpiperazine, 1,4-dibenzylpiperazine, 1,4-bis(2-hydroxy-1-ethyl)piperazine, 1,4-bis(2-hydroxy-1-propyl) piperazine, 1,4-bis(2-hydroxy-1-butyl)piperazine, 1,4-bis(2-hydroxy-1-pentyl)piperazine, and 1,4-bis(2-hydroxy-2-phenyl-1-ethyl)piperazine. Other cyclic amines with at least two reactive nitrogen atoms are melamine and benzimidazoles such as 2-hydroxybenzimidazole and 2-aminobenzimidazole.

Preferred cyclic amines with at least two reactive nitrogen atoms are imidazole, 2-methylimidazole, 4-methylimidazole and piperazine.

In a preferred embodiment of the invention the amine is selected from the group consisting of (i) at least one cyclic amine containing at least two reactive nitrogen atoms and (ii) mixtures of at least one cyclic amine containing containing at least two reactive nitrogen atoms with at least one other amine containing 1 to 6 nitrogen atoms. Examples of other amines containing 1 to 6 nitrogen atoms of which at least one is not quaternary are linear alkyl amines having 1 to 22 carbon atoms in the alkyl group, branched alkylamines, cycloalkylamines, alkoxyamines, amino alcohols, cyclic amines containing one nitrogen atom in a ring structure, alkylenediamines, polyether diamines, and polyalkylenepolyamines containing 3 to 6 nitrogen atoms.

Preferred amines that are used in mixture with at least one cyclic amine with at least two reactive nitrogen atoms are methylamine, ethylamine, propylamine, ethylenediamine, 1,4-diaminobutane, 1,2-diaminobutane, 1,3-diaminopropane, 1,2-diaminopropane, hexamethylenediamine, bishexamethylenetriamine, diethylenetriamine, dipropylenetriamine, triethylentetramine, tetraethylenepentamine, dimethylaminopropylamine and N,N-bis(3-aminopropyl)-N-methylamine.

Most preferred amines that are used in mixture with at least one cyclic amine with at least two reactive nitrogen atoms are ethylenediamine, 1,3-diaminopropane, hexamethylenediamine, dimethylaminopropylamine and N,N-bis(3-aminopropyl)-N-methylamine.

The term "reactive nitrogen atom" means that this nitrogen atom is capable of reacting with for example an alkylating agent, e.g. benzyl chloride, or with a crosslinker, e.g. ethylene chloride or epichlorohydrin and excludes quaternary nitrogen atoms which cannot react further. In accordance with the said meaning primary, secondary and tertiary amino groups contain one reactive nitrogen atom, whereas imidazole contains two.

The amines specified above can be used in mixture with at least one amino acid or a salt thereof. Examples of amino acids are glycine, alanine, aspartic acid, glutamic acid, asparagine, glutamine, lysine, arginine, threonine, 2-phenylglycine, 3-aminopropionic acid, 4-aminobutyric acid, 6-aminocaproic acid, 11-aminoundecanoic acid, iminodiacetic acid, sarcosine, 1-carboxymethylpiperazine, 1,4-bis(carboxymethyl)piperazine, 1-carboxymethylimidazole, imidazole carboxylic acid, anthranilic acid, sulfanilic acid, amidosulfonic acid, aminomethylsulfonic acid, aminoethylsulfonic acid, salts thereof, and mixtures thereof. Preferably per one mole of reactive nitrogen groups in the amines 0.1 to 2 moles of amino acids are used.

Reaction products of the said amines with at least one anionic group containing alkylating agent may be used as component (a) in the process of the invention and are contained in condensed form in the amphoteric amine based polymers having a net cationic charge. Examples of anionic group containing alkylating agents are 2-chloroacetic acid, 3-chloropropionic acid, 2-chloroethanesulfonic acid, epoxysuccinic acid, propane sultone, 3-chloro-2-hydroxypropanesulfonic acid, and mixtures thereof. Other suitable anionic group containing alkylating agents are monoethylenically unsaturated acids such as acrylic acid, methacrylic acid, maleic acid, itaconic acid, and vinylsulfonic acid. This group of alkylating agents reacts with the NH-groups of the amines via Michael addition reaction. Per mole of the NH groups of the amines 0.04 to 0.6 moles of the anionic group containing alkylating agent is used in the production of the amphoteric amine based polymers having a net cationic charge.

A preferred group of polycationic condensation products of the polyelectrolyte complexes is obtainable by condensation of (i) piperazine, 1-alkylpiperazines having 1 to 25 carbon atoms in the alkyl group, 1,4-dialkylpiperazines having 1 to 25 carbon atoms in the alkyl groups, 1,4-bis(3-aminopropyl)piperazine, 1-(2-aminoethyl)piperazine, 1-(2-hydroxyalkyl)piperazines having 2 to 25 carbon atoms in the alkyl group, imidazole, $C_1$— to $C_{25}$—C-alkylimidazoles, aminoalcohols, linear, branched or cyclic alkylamines, other alkylenediamines, polyetherdiamines, polyalkylenepolyamines, or mixtures of said compounds with (ii) epichlorohydrin, bishalohydrins of $C_2$- to $C_8$-diols, bisglycidyl ethers of $C_2$- to $C_{18}$-diols, bisglycidyl ethers of polyalkylene glycols, bisepoxybutane and/or alkylene dihalides in a molar ratio of from 2:1 to 1:1.5, and, if desired, quaternization of the condensation products. The cationic component of these polyelectrolyte complexes is disclosed, for example, in WO-A-98/17762.

The polyelectrolyte complexes preferably comprise, as cationic component (a), polycationic condensation products obtainable by condensation of (i) piperazine, 1-(2-hydroxyethyl)piperazine, 1-(2-aminoethyl)piperazine, imidazole, $C_1$— to $C_3$—C-alkylimidazoles, or mixtures of said compounds with (ii) 1,2-dichloroethane, 1,2-dichloropropane, 1,3-dichloropropane, 1,4-dichlorobutane, epichlorohydrin, bischlorohydrin ethers of diols, bischlorohydrin ethers of polyalkylene glycols, bischlorohydrin ethers of polytetrahydrofurans, bisepoxybutane, or mixtures of said compounds, and (iii) quaternization of the condensation products with alkyl halides, epoxides, chloroacetic acid, 2-chloroethanesulfonic acid, chloropropionic acid, epoxysuccinic acid, propane sulfone, 3-chloro-2-hydroxypropanesulfonic acid, dimethyl sulfate and/or diethyl sulfate, or oxidation of the tertiary nitrogen atoms of the condensation products to N-oxides.

Particular preference is given to polyelectrolyte complexes which comprise, as cationic component (a), polycationic condensation products obtainable by condensation of (i) piperazine, imidazole or mixtures thereof with (ii) epichlorohydrin, where the condensation products have molecular weights Mw of from 500 to 1 million and have a charge density of from 0.8 to 8 mequiv/g, and polyelectrolyte complexes in which at least 80% of the NH groups in the cationic component (a) are in quatemized form or as N-oxides.

If the quaternization is carried out using quaternizing agents containing an anionic group, such as chloroacetic acid or 2-chloroethanesulfonic acid, it is only continued to the extent that the quaternized amphoteric condensation products formed still carry a net cationic charge. The charge density of the cationic component is, for example, from 0.1 to 8, preferably from 0.5 to 7, milliequivalents/g. The molecular weights of the condensation products are in the range from 500 to 1,000,000, preferably from 1000 to 100,000. The amine-epichlorohydrin condensates carry at least 3 cationic or potentially cationic, basic points per polymer molecule. The charges can also be achieved after the condensation by polymer-analogous reaction or by co-condensation of epichlorohydrin with suitable amines.

Amphoteric polymers carrying a net cationic charge which are suitable as component (a) obtainable, for example, by (i) reacting at least 1 amine from the group consisting of linear alkylamines, branched alkylamines, cycloalkylamines, alkoxyamines, aminoalcohols, cyclic amines having at least 1 nitrogen atom in the ring, alkylenediamines, polyetherdiamines, polyalkylenepolyamines, or mixtures of said amines with alkylating agents containing at least one anionic group, such as chloroacetic acid, in such a way that the reaction products are substituted by from 0.04 to 0.6 mol of alkylating agents containing anionic groups per mol of NH groups in the amines, and the reaction products are subsequently (ii) allowed to react with at least one crosslinking agent in an (a):(b) molar ratio of from 2:1 to 1:1.5. Thus, for example, imidazole can firstly be reacted with 3-chloro-2-hydroxypropanesulfonic acid or chloroacetic acid in aqueous solution at temperatures of, for example, from 60 to 100° C., and the reaction product is then crosslinked with epichlorohydrin.

The charge ratio between the anionic and the cationic polymers in the polyelectrolyte complexes is from 0.01 to 20, preferably from 0.1 to 5.

Suitable anionic group containing compounds (b) contain at least three anionic groups, for example, polyacids such as citric acid, butane tetracarboxylic acid, cyclopentane tetracarboxylic acid, sulfoisophthalic acid and iminodisuccinic acid, oxodisuccinic acid as described in U.S. Pat. No. 3,128,287, incorporated herein by reference, ether carboxylates such as tartrate monosuccinic acid and tartrate disuccinic acid, as described in U.S. Pat. No. 4,663,071 incorporated herein by reference and polymers of acid group containing monomers such as homopolymers and copolymers of monoethylenically unsaturated $C_3$- to $C_{10}$-carboxylic acids or their anhydrides, for example acrylic acid, methacrylic acid, acrylic anhydride, methacrylic anhydride, maleic acid, maleic anhydride, fumaric acid, crotonic acid, itaconic acid, itaconic anhydride, citraconic acid, mesaconic acid, methylenemalonic acid, 1,2,3,6-tetrahydrophthalic anhydride, 2-acrylamido-2-methylpropanesulfonic acid, allylsulfonic acid, methallylsulfonic acid, vinylsulfonic acid, styrenesulfonic acid and salts of the above monomers. The anionic monomers are soluble in water or dissolve in partially or fully base-neutralized form. In the present connection, the term "water-soluble monomers" is taken to mean all anionic monomers which have a water-solubility at 20° C. of greater than 20 g/l. In order to prepare the salts of the hydrophilic monomers, use is made, for example, of alkali metal bases, alkaline earth metal bases and ammonia or amines. Preferred salts of the hydrophilic monomers are the sodium and potassium salts and the ammonium salts, which are obtainable by neutralization of the acid groups of the monomers using, for example, sodium hydroxide solution, potassium hydroxide solution or ammonia.

Further suitable anionic polymers are homopolymers and copolymers of, for example, monoesters of maleic acid and alcohols having 1 to 25 carbon atoms or monoamides of maleic acid.

Other suitable anionic polymers are copolymers of maleic anhydride with $C_4$- to $C_{12}$-olefins, particularly preferably $C_8$-olefins, such as 1-octene and diisobutene. Very particular preference is given to diisobutene. The molar ratio between maleic anhydride and olefin is, for example, in the range from 0.9:1 to 3:1, preferably from 0.95:1 to 1.5:1. These copolymers are employed in hydrolyzed form as an aqueous solution or dispersion, where the anhydride group is in opened form and some or all of the carboxyl groups have preferably been neutralized. The following bases, for example, are employed for the neutralization: alkali metal bases, such as sodium hydroxide, potassium hydroxide, sodium carbonate, potassium carbonate, alkaline earth metal salts, such as calcium hydroxide, calcium carbonate, magnesium hydroxide, ammonia, primary, secondary or tertiary amines, such as triethylamine, triethanolamine, diethanolamine etc. If desired, the preferred copolymers of maleic anhydride with $C_4$–$C_{12}$-olefins can also be partially reacted polymer-analogously at the anhydride function. To this end, alcohols or amines having 1 to 25 carbon atoms, furthermore also alkoxylated alcohols, for example, are suitable.

Preferred anionic polymers (b) are homopolymers and copolymers of monoethylenically unsaturated $C_3$- to $C_8$-carboxylic acids, homopolymers and copolymers of monomers containing sulfonic acid groups, homopolymers and copolymers of monomers containing phosphonic acid groups, water-soluble salts of said polymers, and mixtures of said polymers.

The copolymers are prepared by known methods of free-radical polymerization, such as solution polymerization, emulsion polymerization, dispersion polymerization, precipitation polymerization and melt polymerization. Suitable solvents or diluents are the conventional compounds, for example water, alcohols, ketones, esters, aliphatic compounds, aromatic compounds or mixtures, for example water/isopropanol mixtures. The solvents or diluents employed can also be one or more of the monomers, or the use of a solvent or diluent can be omitted entirely. The polymerizations can be carried out either as a batch reaction or with one or more feeds. In this case, the feed times and the amounts of individual components per time unit can be varied. This enables the parameters, such as copolymer composition, mean molecular weight or molecular weight distribution, to be controlled characteristically.

Water-soluble polyanions have, for example, molecular weights M, of from 1000 to 10,000,000, preferably from 2000 to 500,000. Component (b) of the polyelectrolyte complexes according to the invention is, in particular, a polycarboxylic acid having a molecular weight $M_w$ of from 1000 to 250,000 in the unneutralized form, partially neutralized form or fully neutralized form. Individual examples of water-soluble anionic polymers (b) are the following:

- polyacrylic acid having molecular weights of from 1000 to 250,000,
- polymethacrylic acid having molecular weights of from 1000 to 250,000,
- polymaleic acid having molecular weights of from 200 to 5,000,
- copolymers or terpolymers of acrylic acid, methacrylic acid or maleic acid, for example acrylic acid-methacrylic acid copolymers having molecular weights of from 1000 to 100,000
- acrylic acid-maleic acid copolymers having molecular weights of from 1000 to 100,000
- methacrylic acid-maleic acid copolymers having molecular weights of from 1000 to 100,000

Other suitable copolymers are, for example, acrylonitrile, methacrylonitrile, styrene, methyl acrylate, methyl methacrylate, ethyl methacrylate, hydroxyethyl (meth) acrylate, hydroxypropyl(meth)acrylate, alkylpolyethylene glycol(meth)acrylate, allyl alcohol, acrylamide, methacrylamide, N-dimethylacrylamide, vinyl acetate, vinyl propionate, vinyl phosphonate, allyl phosphonate, N-vinylpyrrolidone, N-vinylcaprolactam, N-vinylformamide, vinylphosphonic acid. It is furthermore also possible to copolymerize cationic copolymers in a secondary amounts (<10% by weight) so long as the copolymers formed carry a net anionic charge.

Examples of polymers which contain at least 10% by weight of copolymerized unsaturated carboxylic acids are the following:

- styrene-acrylic acid copolymers having molecular weights of from 1000 to 100,000
- styrene-maleic acid copolymers having molecular weights of from 1000 to 100,000
- olefin-maleic acid copolymers with $C_2$- to $C_{1500}$-olefins, for example
  - isobutene-maleic acid copolymers having molecular weights of from 1000 to 10,000
  - diisobutene-maleic acid copolymers having molecular weights of from 1000 to 10,000
  - $C_{12}$-olefin-maleic acid copolymers having molecular weights of from 1000 to 10,000
  - $C_{20/24}$-olefin-maleic acid copolymers having molecular weights of from 1000 to 10,000
  - vinyl acetate-acrylic acid copolymers having molecular weights of from 1000 to 100,000
  - vinyl acetate-maleic acid copolymers having molecular weights of from 1000 to 100,000
  - vinyl acetate-acrylic acid-maleic acid terpolymers having molecular weights of from 1000 to 100,000
  - acrylamide-acrylic acid copolymers having molecular weights of from 1000 to 100,000
  - polystyrene sulfonate having molecular weights of from 1000 to 250,000

Further anionic polymers are homocondensates and co-condensates of aspartic acid and lysine, for example polyaspartic acid having molecular weights $M_w$ of from 1000 to 100,000.

The present invention also relates to a process for the preparation of polyelectrolyte complexes by mixing cationic polymers with anionic polymers. In accordance with the invention, (a) cationic condensates of (i) at least one amine and
  (ii) a crosslinking agent from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides and/or mixtures of said compounds, and
(b) anionic compounds containing at least three anionic groups.

The polyelectrolyte complexes can either be in the form of a microscopic or macroscopic 2nd phase in aqueous systems and formulations or homogeneously dissolved. The polyelectrolyte complexes are preferably prepared by combining aqueous solutions of the cationic and anionic polymers, by introducing an anionic polymer into a solution of a cationic polymer or by introducing a cationic polymer into a solution of anionic polymers. However, it is also possible to prepare polyelectrolyte complexes by mixing anionic and cationic polymers in suitable joint solvents or in the absence of solvents. However, the polyelectrolyte complexes are preferably prepared in aqueous medium. For the preparation of the polyelectrolyte complexes, an aqueous solution containing from 1 to 60% by weight, preferably from 2 to 55% by weight, of a cationic condensate (a) in dissolved form, for example, is mixed with a 1 to 60% strength by weight aqueous solution of an anionic polymer (b). The aqueous solution of the anionic polymer preferably contains from 2 to 55% by weight of anionic polymer in dissolved form.

The polyelectrolyte complexes are preferably prepared by turbulent mixing. A further preferred embodiment for the preparation of the polyelectrolyte complexes is a joint spraying of the solution of a cationic condensate and the solution of an anionic polymer.

Either homogeneous solutions or dispersions of polyelectrolyte complexes are obtained. The mixing of the two polymers of different charge can be carried out, for example, in a stirred tank reactor or in turbulent flow, for example in a nozzle. If the polyelectrolyte complexes are in the form of a solution or dispersion, the diluents can be removed by, for example, spraying the solutions or dispersions with evaporation of the solvent. Pulverulent polyelectrolyte complexes are then obtained.

In the polyelectrolyte complexes, the charge ratio between anionic and cationic polymers is from 0.01 to 20, preferably in the range from 0.1 to 5.

The cationic component of the polyelectrolyte complexes has been used for some time as an auxiliary in textile finishing and in the after-treatment of washed textile goods. However, a broad application in complex formulations in which a wide variety of interactions of the constituents with one another can change the mode of action of the individual formulation constituents is not possible owing to the strong interaction of the cationic polymers with the usually anionic dispersants, detergents or emulsifiers. By contrast, complex formation between cationic and anionic polymers results in an aggregate which is very stable, even in very dilute media. A strong interaction with low-molecular-weight anionic formulation constituents is prevented owing to charge interactions in the complexes. By contrast, the action of the cationic condensates remains comparable in the polyelectrolyte complexes according to the invention. This gives rise to the possibility of incorporating the action of polycations into complex formulations with a large number of possible interactions. On use of the polyelectrolyte complexes in detergents or additives for textile washing, textile care is obtained through which the outward appearance, such as color impression, mechanical and micromechanical properties, such as hardness, flexibility and tear strength of filaments, fibers and fabrics, is improved. For fabric care, the textile materials can also be impregnated, sprayed or coated with solutions or dispersions of the complexes according to the invention.

Suitable copolymers are commercially available in the U.S. under the trade names SOKALAN® from BASF Corporation and ACUSOL® from Rohm and Haas Company. Non-limiting examples include: SOKALAN® CP5, a maleic acid/acrylic acid copolymer with an approximate ratio of maleic acid/acrylic acid of 30/70; SOKALAN® CP7 with an approximate ratio of maleic acid/acrylic acid of 50/50; SOKALAN® CP12S with an approximate ratio of maleic acid/acrylic acid of 50/50; ACUSOL® 445N, a fully-neutralized polyacrylic acid and sodium salt polymer; ACUSOL® 480N, a fully-neutralized modified polyacrylic acid and sodium salt polymer; and ACUSOL® 505N, a fully-neutralized acrylic acid/maleic acid sodium salt copolymer.

It is preferred that the polyelectolyte component is prepared prior to combination with any other detergent materials. Once again, while not wishing to be bound by theory, it is believed that when the cationic and anionic polymers are combined, the polymeric ion pairs are more likely to be formed with minimum interference from other constituents of the detergent composition. Once the polymeric ion pair is formed, the individual polymer ions are less likely to dissociate and react with other detergent constituents. This polymeric ion pair imparts improved cleaning benefit when compared with the cyclic amine based polymer. Suitable cationic, anionic and cyclic amine based polymers can be prepared as illustrated by the examples.

Detersive Surfactant

The detergent compositions herein comprise from about 1% to 80% by weight of a detersive surfactant. Preferably such compositions comprise from about 5% to 50% by weight of surfactant. Detersive surfactants utilized can be of the anionic, nonionic, zwitterionic, ampholytic or cationic type or can comprise compatible mixtures of these types. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. All of these patents are incorporated herein by reference. Of all the surfactants, anionics and nonionics are preferred.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Especially valuable are linear straight chain alkylbenzene sulfonates in which the average number of carbon atoms in the alkyl group is from about 11 to 13, abbreviated as $C_{11-13}$ LAS.

Preferred nonionic surfactants are those of the formula $R_1(OC_2H_4)_nOH$, wherein $R_1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable surfactants, including polyhydroxy fatty acid amides and amine based surfactants, are disclosed in co-pending PCT Application PCT/US98/19143, entitled Laundry Detergent Compositions with Cyclic Amine Based Polymers to Provide Appearance and Integrity Benefits to Fabrics Laundered Therewith, which was filed on Sep. 15, 1998, in the name of Panandiker et al. [P&G Case No. 6834]. The entire disclosure of the Panandiker et al. reference is incorporated herein by reference.

Detergent Builder

The detergent compositions herein may also comprise from about 0.1% to 80% by weight of a detergent builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al., U.S. Pat. No. 4,605,509, the disclosure of which is incorporated herein by reference. Also discussed in U.S. Pat. No. 4,605,509 are crystalline layered silicates which are suitable for use in the detergent compositions of this invention.

Optional Detergent Ingredients

In addition to the surfactants, builders and cyclic amine based polymers, oligomers or copolymers hereinbefore described, the detergent compositions of the present invention can also include any number of additional optional ingredients. These include conventional detergent composition components such as enzymes and enzyme stabilizing agents, suds boosters or suds suppressers, anti-tarnish and anticorrosion agents, bleaching agents, soil suspending agents, soil release agents, germicides, pH adjusting agents, non-builder alkalinity sources, chelating agents, organic and inorganic fillers, solvents, hydrotropes, optical brighteners, dyes and perfumes. pH adjusting agents may be necessary in certain applications where the pH of the wash solution is greater than about 10.0 because the fabric integrity benefits of the defined compositions begin to diminish at a higher pH. Hence, if the wash solution is greater than about 10.0 after the addition of the cyclic amine based polymers, oligomers or copolymers and optional hydrophobically modified cellulosic based polymers or oligomers of the present invention a pH adjuster should be used to reduce the pH of the washing solution to below about 10.0, preferably to a pH of below about 9.5 and most preferably below about 7.5. Suitable pH adjusters will be known to those skilled in the art.

A preferred optional ingredients for incorporation into the detergent compositions herein comprises a bleaching agent, e.g., a peroxygen bleach. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used, generally in particulate form, in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L \text{ or } R_1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamidocaproyl) oxybenzenesulfonate, (6-nonanamidocaproyl) oxybenzenesul-fonate, (6-decanamidocaproyl)oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966,723, Issued Oct. 30, 1990, incorporated herein by reference. See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If utilized, peroxygen bleaching agent will generally comprise from about 2% to 30% by weight of the detergent compositions herein. More preferably, peroxygen bleaching agent will comprise from about 2% to 20% by weight of the compositions. Most preferably, peroxygen bleaching agent will be present to the extent of from about 3% to 15% by weight of the compositions herein. If utilized, bleach activators can comprise from about 2% to 10% by weight of the detergent compositions herein. Frequently, activators are employed such that the molar ratio of bleaching agent to activator ranges from about 1:1 to 10:1, more preferably from about 1.5:1 to 5:1.

Additional suitable bleaching agents and bleach activators are disclosed in PCT Application PCT/US98/19143, entitled Laundry Detergent Compositions with Cyclic Amine Based Polymers to Provide Appearance and Integrity Benefits to Fabrics Laundered Therewith, which was filed on Sep. 15, 1998, in the name of Panandiker et al. [P&G Case No. 6834]. The entire disclosure of the Panandiker et al. reference was incorporated by reference above.

Another highly preferred optional ingredient in the detergent compositions herein is a detersive enzyme component. Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability, optimal thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry detergent composition. Preferred enzymes for laundry purposes include, but are not limited to, proteases, cellulases, lipases, amylases and peroxidases.

Enzymes are normally incorporated into detergent compositions at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. Higher active levels may be desirable in highly concentrated detergent formulations.

Cellulases usable herein include those disclosed in U.S. Pat. No. 4,435,307, Barbesgoard et al., Mar. 6, 1984, and GB-A-2.075.028; GB-A-2.095.275 and DE-OS-2.247.832. CAREZYME® and CELLUZYME® (Novo) are especially useful. See also WO 9117243 to Novo.

The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

Detergent Composition Preparation

The detergent compositions according to the present invention can be in granular form. Such compositions can be prepared by combining the essential and optional components in the requisite concentrations in any suitable order and by any conventional means. The forgoing description of uses for the polyelectolyte complexes defined herein is intended to be exemplary and other uses will be apparent to those skilled in the art and are intended to be within the scope of the present invention.

Granular compositions are generally made by combining base granule ingredients, e.g., surfactants, builders, water, etc., as a slurry, and spray drying the resulting slurry to a low level of residual moisture (5–12%). The remaining dry ingredients, e.g., granules of the cyclic amine based polymers, oligomers or copolymers and optional hydrophobically modified cellulosic based polymers or oligomers, can be admixed in granular powder form with the spray dried granules in a rotary mixing drum. The liquid ingredients, e.g., solutions of the polyelectolyte complexes, enzymes, binders and perfumes, can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulfates and chlorides, typically sodium sulfate; "compact" detergents typically comprise not more than 10% filler salt.

Fabric Laundering Method

The present invention also provides a method for laundering fabrics in a manner which imparts fabric appearance benefits provided by the polyelectolyte complexes used herein. Such a method employs contacting these fabrics with an aqueous washing solution formed from an effective amount of the detergent compositions hereinbefore described or formed from the individual components of such compositions. Contacting of fabrics with washing solution will generally occur under conditions of agitation although the compositions of the present invention may also be used to form aqueous unagitated soaking solutions for fabric cleaning and treatment. As discussed above, it is preferred that the washing solution have a pH of less than about 10.0, preferably it has a pH of about 9.5 and most preferably it has a pH of about 7.5.

Agitation is preferably provided in a washing machine for good cleaning. Washing is preferably followed by drying the wet fabric in a conventional clothes dryer. An effective amount of a high density liquid or granular detergent composition in the aqueous wash solution in the washing machine is preferably from about 500 to about 7000 ppm, more preferably from about 1000 to about 3000 ppm.

Fabric Conditioning and Softening

The polyelectolyte complexes hereinbefore described as components of the laundry detergent compositions herein may also be used to treat and condition fabrics and textiles in the absence of the surfactant and builder components of the detergent composition embodiments of this invention. Thus, for example, a fabric conditioning composition comprising only the polyelectolyte complexes themselves, or comprising an aqueous solution of the polyelectolyte complexes, may be added during the rinse cycle of a conventional home laundering operation in order to impart the desired fabric appearance and integrity benefits hereinbefore described.

Additional suitable fabric softening agents are disclosed in PCT Application PCT/US98/19143, entitled Laundry Detergent Compositions with Cyclic Amine Based Polymers to Provide Appearance and Integrity Benefits to Fabrics Laundered Therewith, which was filed on Sep. 15, 1998, in the name of Panandiker et al. [P&G Case No. 6834]. The entire disclosure of the Panandiker et al. reference was incorporated by reference above.

The compositions of the present invention comprise at least about 1%, preferably from about 10%, more preferably from about 20% to about 80%, more preferably to about 60% by weight, of the composition of one or more fabric softener actives.

EXAMPLES

The following examples illustrate the compositions and methods of the present invention, but are not necessarily meant to limit or otherwise define the scope of the invention.

Example 1

Synthesis of the Adduct of Imidazole and Epichlorohydin (Ratio of Midazole:epichlorohydrin 1.4:1)

To a round bottomed flask equipped with a magnetic stirrer, condenser and a thermometer are added imidazole (0.68 moles) and 95 ml water. The solution is heated to 50° C. followed by dropwise addition of epichlorohydrin (0.50 moles). After all the epichlorohydrin is added, the temperature is raised to 80° C. until all the alkylating agent is consumed. The condensate produced had molecular weight of about 2000.

Example 2

A 50% aqueous solution of the condensate from Example 1 is mixed with sodium polyacrylate (MW=4500 ex. Aldrich Chemicals, Milwaukee Wis.) and stirred until completely homogeneous. The mixture is adjusted with acid/alkali such that the pH of 10% solution of the mixture=6.0–6.4. The mixture is further stirred for another hour. It is then spray dried or agglomerated.

Example 3

A 50% aqueous solution of the condensate from Example 1 is mixed with sodium salt of acrylic-maleic copolymer (MW=70,000, ratio of maleic:acrylic=30:70) sold under the trade name Sokalan CP5 (ex. BASF Corp., Mount Olive N.J.) and stirred until completely homogeneous. The mixture is adjusted with acid/alkali such that the pH of 10% solution of the mixture=6.0–6.4. The mixture is further stirred for another hour. It is then spray dried or agglomerated.

Example 4

50% aqueous solution of the condensate from Example 1 is mixed with acrylic acid-maleic acid copolymer free acid (MW=3000, ratio of maleic:acrylic=50:50) sold under the trade name Sokalan CP12S (ex. BASF Corp., Mount Olive N.J.) and stirred until completely homogeneous. The mixture is adjusted with acid/alkali such that the pH of 10% solution of the mixture=6.0–6.4. The mixture is further stirred for another hour. It is then spray dried or agglomerated.

Example 5

A 50% aqueous solution of the condensate from Example 1 is mixed with sodium citrate (ex. Aldrich Chemicals, Milwaukee Wis.) and stirred until completely homogeneous. The mixture is adjusted with acid/alkali such that the pH of 10% solution of the mixture=6.0–6.4. The mixture is further stirred for another hour. It is then spray dried or agglomerated.

Example 6

A 50% aqueous solution of the condensate from Example 1 is mixed with oxydisuccinic acid (ex. Aldrich Chemicals, Milwaukee Wis.) and stirred until completely homogeneous. The mixture is adjusted with acid/alkali such that the pH of 10% solution of the mixture=6.0–6.4. The mixture is further stirred for another hour. It is then spray dried or agglomerated.

Example 7

A 50% aqueous solution of the condensate from Example 1 is mixed with sodium styrene sulfonate (MW=2000 ex. Polysciences, Warrington, Pa.) and stirred until completely homogeneous. The mixture is adjusted with acid/alkali such that the pH of 10% solution of the mixture=6.0–6.4. The mixture is further stirred for another hour. It is then spray dried or agglomerated.

Example 8

Synthesis of the Adduct of Piperazine and Epichlorohydin (Ratio of Piperazine:epichlorohydrin 1:1)

To a round bottomed flask equipped with a magnetic stirrer, condenser and a thermometer are added piperazine (0.68 moles) and 95 ml water. The solution is heated to 50° C. followed by dropwise addition of epichlorohydrin (0.68 moles). After all the epichlorohydrin is added, the temperature is raised to 80° C. until all the alkylating agent is consumed.

Example 9

A 50% aqueous solution of the condensate from Example 8 is mixed with sodium polyacrylate (MW=4500 ex. Aldrich Chemicals, Milwaukee Wis.) and stirred until completely homogeneous. The mixture is adjusted with acid/alkali such that the pH of 10% solution of the mixture=6.0–6.4. The mixture is further stirred for another hour. It is then spray dried or agglomerated.

Example 10

A 50% aqueous solution of the condensate from Example 8 is mixed with sodium salt of acrylic-maleic copolymer (MW=70,000, ratio of maleic:acrylic=30:70) sold under the trade name SokalanCP5 (ex. BASF Corp., Mount Olive N.J.) and stirred until completely homogeneous. The mixture is adjusted with acid/alkali such that the pH of 10% solution of the mixture=6.0–6.4. The mixture is further stirred for another hour. It is then spray dried or agglomerated.

Example 11

Synthesis of the Adduct of Imidazole and Epichlorohydin and Chloroacetic Acid (Ratio of Imidazole:epichlorohydrin:chloroacetic Acid 1.36:0.83:0.34

To a round bottomed flask equipped with a magnetic stirrer, condenser and a thermometer are added imidazole (1.36 moles) and 190 ml water. The solution is heated to 50° C. followed the addition of 0.34 moles of chloroacetic acid. The reaction mixture is mixed for about an hour followed by dropwise addition of epichlorohydrin (0.83 moles). After all the epichlorohydrin is added, the temperature is raised to 80° C. until all the alkylating agent is consumed. The condensate produced had molecular weight of about 1200.

Example 12

A 50% aqueous solution of the condensate from Example 11 is mixed with sodium polyacrylate (MW=4500 ex. Aldrich Chemicals, Milwaukee Wis.) and stirred until completely homogeneous. The mixture is adjusted with acid/alkali such that the pH of 10% solution of the mixture=6.0–6.4. The mixture is further stirred for another hour. It is then spray dried or agglomerated.

Example 13

A 50% aqueous solution of the condensate from Example 11 is mixed with sodium salt of acrylic-maleic copolymer (MW=70,000, ratio of maleic:acrylic=30:70) sold under the trade name SokalanCP5 (ex. BASF Corp., Mount Olive N.J.) and stirred until completely homogeneous. The mixture is further stirred for another hour. It is then spray dried or agglomerated.

Example 14

Synthesis of the adduct of bis(hexamethylenetriamine) and epichlorohydin (Ratio of bis(hexamethylenetriamine) :epichlorohydrin 2:1 was completed as described in WO 99/14297. The resultant waxy material is acidified water. The aqueous solution is mixed with sodium polyacrylate (MW=4500 ex. Aldrich Chemicals, Milwaukee Wis.) and stirred until completely homogeneous. The mixture is adjusted with acid/alkali such that the pH of 10% solution of the mixture=6.0–6.4. The mixture is further stirred for another hour. It is then spray dried or agglomerated.

Example 15

Synthesis of the adduct of aminopropyldiethanolamine and epichlorohydin (Ratio of aminopropyldiethanolamine:epichlorohydrin 2:1 was completed as described in WO 99/14297A. The adduct is disolved in acidified water and mixed with sodium salt of acrylic-maleic copolymer (MW=70,000, ratio of maleic:acrylic=30:70) sold under the trade name SokalanCP5 (ex. BASF Corp., Mount Olive N.J.) and stirred until completely homogeneous. The mixture is adjusted with acid/alkali such that the pH of 10% solution of the mixture=6.0–6.4. The mixture is further stirred for another hour. It is then spray dried or agglomerated.

Example 16

Synthesis of the adduct of diethylaminoethylamine and epichlorohydin (Ratio of diethylaminoethylamine:epichlorohydrin 2:1 was completed as described in WO 99/14297A. The adduct is disolved in acidified water and mixed with sodium salt of acrylic-maleic copolymer (MW=70,000, ratio of maleic:acrylic=30:70) sold under the trade name SokalanCP5 (ex. BASF Corp., Mount Olive N.J.) and stirred until completely homogeneous. The mixture is adjusted with acid/alkali such that the pH of 10% solution of the mixture=6.0–6.4. The mixture is further stirred for another hour. It is then spray dried or agglomerated.

Example 17

A heavy duty detergent powder of the following ingredients is prepared:

| Component | Example Wt. % | Comparative Wt. % |
|---|---|---|
| Na $C_{12}$ Linear alkyl benzene sulfonate | 9.40 | 9.40 |
| Na $Cl_{14-15}$ alkyl sulfonate | 11.26 | 11.26 |

-continued

| Component | Example Wt. % | Comparative Wt. % |
|---|---|---|
| Zeolite Builder | 27.79 | 27.79 |
| Sodium Carbonate | 27.31 | 27.31 |
| PEG 4000 | 1.60 | 1.60 |
| Dispersant, Na polyacrylate | 2.26 | 2.26 |
| $C_{12-13}$ alkyl ethoxylate (E9) | 1.5 | 1.5 |
| Sodium Perborate | 1.03 | 1.03 |
| Polymer/Oligomer shown in Example 2* | 1.6 | 0 |
| Other Adjunct ingredients | Balance 100% | Balance 100% |

* Polymers/oligomers from examples 3, 4, 5, 7, 8, 10, 11, 12, 13, 14, 15 and 16 can be used instead. Mixtures of polymers can be used as well.

What is claimed is:

1. A detergent composition comprising:

(A) a detersive surfactant system;

(B) a polyelectrolyte complex of cationic and anionic polymers comprising:

(a) cationic condensates of (i) at least one amine selected from the group consisting of linear alkylamines, branched alkylamines, cycloalkylamines, alkoxyamines, amino alcohols, cyclic amines containing at least one nitrogen atom in a ring structure, alkylenediamines, polyetherdiamines, polyalkylenepolyamines, mixtures of one of the said amines with at least one amino acid or a salt thereof, reaction products of the said amines with at least one anionic group containing alkylating agent wherein per mole of NH group of the amines of from 0.04 to 0.6 moles of the anionic group containing alkylating agent is reacted, and mixtures thereof, and (ii) a crosslinking agent selected from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides, mixtures thereof, and quaternized cationic condensates of (i) and (ii) and;

(b) a polymeric anion source with at least 3 anionic groups and a total net charge of at least 4 negative charges;

wherein the charge ratio between anionic and cationic polymers is from 0.01 to 20;

(C) an inorganic peroxygen bleaching compound and a bleach activator; and (D) the balance detergent adjunct ingredients.

2. A detergent composition according to claim 1, wherein said polymeric anion source is selected from the group consisting of polyvinyl sulfonate, copolymers of polyvinyl sulfonate, polystyrene sulfonate, copolymers of polystyrene sulfonate, polyacrylate, copolymers of polyacrylate, polymaleate, copolymers of polymaleate, polymethacrylate, copolymers of polymethacrylate, polymethyl-methacrylate, copolymers of polymethyl-methacrylate, polyaspartate, copolymers of polyaspartate, and mixtures thereof.

3. A detergent composition according to claim 1 wherein the polyelectrolyte complex comprises, as cationic component (a), polycationic condensation products obtainable by condensation of (i) piperazine, 1-alkylpiperazines having 1 to 25 carbon atoms in the alkyl group, 1,4-dialkylpiperazines having 1 to 25 carbon atoms in the alkyl groups, 1,4-bis(3-aminopropyl)piperazine, 1-(2-aminoethyl)piperazine, 1-(2-hydroxyalkyl)piperazines having 2 to 25 carbon atoms in the alkyl group, imidazole, $C_1$— to $C_{25}$—C-alkylimidazoles, aminoalcohols, linear, branched or cyclic alkylamines, other alkylenediamines, polyetherdiamines, polyalkylenepolyamines, or mixtures of said compounds with (ii) epichlorohydrin, bishalohydrins of $C_2$- to $C_8$-diols. bisglycidyl ethers of $C_2$- to $C_{18}$-diols, bisglycidyl ethers of polyalkylene glycols, bisepoxybutane and/or alkylene dihalides in a molar ratio of from 2:1 to 1:1.5, wherein the condensation products are optionally, quaternized.

4. A detergent composition according to claim 1 wherein the polyelectrolyte complex comprises, as cationic component (a), polycationic condensation products obtainable by condensation of (i) piperazine, 1-(2-hydroxyethyl)piperazine, 1-(2-aminoethyl)piperazine, imidazole, $C_1$— to $C_3$—C-alkylimidazoles, and mixtures thereof with (ii) 1,2-dichloroethane, 1,2-dichloropropane, 1,3-dichloropropane, 1,4-dichlorobutane, epichlorohydrin, bischlorohydrin ethers of diols, bischlorohydrin ethers of polyalkylene glycols, bischlorohydrin ethers of polytetrahydrofurans, bisepoxybutane, and mixtures thereof, and (iii) quaternization of the condensation products using alkyl halides, epoxides, chloroacetic acid, 2-chloroethanesulfonic acid, chloropropionic acid, epoxysuccinic acid, propane sulfone, 3-chloro-2-hydroxypropanesulfonic acid, dimethyl sulfate and/or diethyl sulfate, or oxidation of the tertiary nitrogen atoms of the condensation products to N-oxides.

5. A detergent composition comprising:

from about 1% to about 80% by weight of surfactants selected from the group consisting of nonionic, anionic, cationic, amphoteric zwitterionic surfactants and mixtures thereof; an inorganic peroxygen bleaching compound and a bleach activator; and a polyelectrolyte complex of cationic and anionic polymers which consists of (a) cationic condensates of (i) at least one amine selected from the group consisting of linear alkylamines, branched alkylamines, cycloalkylamines, alkoxyamines, amino alcohols, cyclic amines containing at least one nitrogen atom in a ring structure, alkylenediamines, polyetherdiamines, polyalkylenepolyamines, mixtures of one of the said amines with at least one amino acid or a salt thereof, reaction products of the said amines with at least one anionic group containing alkylating agent wherein per mole of NH group of the amines of from 0.04 to 0.6 moles of the anionic group containing alkylating agent is reacted, and mixtures thereof, and (ii) a crosslinking agent from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides, mixtures thereof, and quaternized cationic condensates of (i) and (ii) and;

(b) a polymeric anion source with at least 3 anionic groups and a total net charge of at least 4 negative charges;

wherein the charge ratio between anionic and cationic polymers is from 0.01 to 20.

6. A detergent composition according to claim 1 wherein the polyelectrolyte complex comprises, as cationic component (a), polycationic condensation products obtainable by condensation of (i) piperazine, imidazole or mixtures thereof with (ii) epichlorohydrin, where the condensation products have molecular weights Mw of from 500 to 1 million and have a charge density of from 0.1 to 8 mequiv/g.

7. A detergent composition according to claim 1 wherein at least 80% of the NH groups of the cationic component (a) are in quaternized form or as N-oxides.

8. A detergent composition according to claim 1 wherein the polycationic condensation products have a molecular weight Mw of from 1000 to 100,000.

9. A detergent composition according to claim 2, wherein the composition further comprises a detersive enzyme.

10. A detergent composition according to claim 3, wherein the composition further comprises a detersive enzyme.

11. A detergent composition according to claim 4, wherein the composition further comprises a detersive enzyme.

12. A detergent composition according to claim 2, wherein the composition further comprises a cellulase enzyme.

13. A detergent composition according to claim 3, wherein the composition further comprises a cellulose enzyme.

14. A detergent composition according to claim 4, wherein the composition further comprises a cellulase enzyme.

15. A laundry additive composition comprising:

a) from about 1% to about 80% by weight of water;

b) a polyelectrolyte complex of cationic and anionic polymers comprising:

(i) cationic condensates of (ii) at least one amine and (iii) a crosslinking agent from the group consisting of epihalohydrins, bishalohydrins of diols, bishalohydrins of polyalkylene glycols, bishalohydrins of polytetrahydrofurans, alkylene dihalides, alkylene trihalides, bisepoxides, trisepoxides, tetraepoxides, mixtures thereof, and quaternized cationic condensates of (ii) and (iii) and;

(ii) a polymeric anion source with at least 3 anionic groups and a total net charge of at least 4 negative charges; and an inorganic peroxygen bleaching compound and a bleach activator;

wherein the charge ratio between anionic and cationic polymers is from 0.01 to 20.

16. The laundry additive composition of claim 15, wherein the composition further comprises a pH adjuster and one or more fabric softening components.

17. The laundry additive composition of claim 15, wherein the composition further comprises a cellulase enzyme.

* * * * *